US008654015B2

(12) United States Patent
Saito

(10) Patent No.: US 8,654,015 B2
(45) Date of Patent: Feb. 18, 2014

(54) ANTENNA, ADJUSTMENT METHOD THEREOF, AND ELECTRONIC DEVICE IN WHICH THE ANTENNA IS MOUNTED

(75) Inventor: Katsuo Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 282 days.

(21) Appl. No.: 13/287,438

(22) Filed: Nov. 2, 2011

(65) Prior Publication Data

US 2012/0139809 A1 Jun. 7, 2012

(30) Foreign Application Priority Data

Dec. 3, 2010 (JP) ..... 2010-270793
Oct. 12, 2011 (JP) ..... 2011-225300

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 848
See application file for complete search history.

(56) References Cited

U.S. PATENT DOCUMENTS

| | | | | |
|---|---|---|---|---|
| 5,483,249 | A | 1/1996 | Kennedy | |
| 6,600,448 | B2 | 7/2003 | Ikegaya et al. | |
| 7,825,859 | B2 * | 11/2010 | Teshima | 343/700 MS |
| 8,456,366 | B2 * | 6/2013 | Vance | 343/700 MS |
| 2008/0204346 | A1 | 8/2008 | Tawata | |

FOREIGN PATENT DOCUMENTS

| | | | |
|---|---|---|---|
| JP | 09-162642 | A | 6/1997 |

* cited by examiner

*Primary Examiner* — Tan Ho
(74) *Attorney, Agent, or Firm* — Carter, DeLuca, Farrell & Schmidt LLP

(57) ABSTRACT

An antenna used in wireless communication, provided with an antenna element and a GND portion on a dielectric board and mounted in an electronic device, includes a open conductor having a high-frequency connection to the GND portion at an end of the dielectric board in the opposing corner direction from a power supply point of the antenna element. The length of the GND portion in the vertical direction relative to the propagation direction of a high-frequency signal is less than ¼ the wavelength of the operating frequency of the antenna element.

7 Claims, 21 Drawing Sheets

FIG. 10

| θ | RL(dB) | θ | RL(dB) |
|---|---|---|---|
| 0 | -7.4 | 120 | <-10 |
| 15 | -8.6 | 135 | <-10 |
| 30 | -10 | 180 | <-10 |
| 45 | -14 | | |
| 60 | -18 | | |
| 90 | -24 | | |

FIG. 14

| Ls(mm) | RL(dB) |
|---|---|
| 20 | -3.1 |
| 15 | -6.9 |
| 10 | -16.0 |
| 5 | -7.1 |
| 0 | -6.1 |

FIG. 16

| Ls(mm) | RL(dB) |
|---|---|
| 20 | -5.8 |
| 15 | -4.2 |
| 10 | -7.7 |
| 5 | -12.3 |
| 0 | -11.9 |

| θ | RL(dB) | θ | RL(dB) |
|---|---|---|---|
| 0 | -7.3 | 135 | -14.0 |
| 15 | -7.8 | 150 | -12.3 |
| 30 | -9.4 | 180 | -11.7 |
| 45 | -11.3 | | |
| 90 | -13.9 | | |

ANTENNA, ADJUSTMENT METHOD THEREOF, AND ELECTRONIC DEVICE IN WHICH THE ANTENNA IS MOUNTED

BACKGROUND OF THE INVENTION

1. Field of the Invention

The present invention relates to antennae used in wireless communication that are mounted in electronic devices, adjustment methods for such antennae, and electronic devices in which such antennae are mounted.

2. Description of the Related Art

In recent years, electronic devices such as personal computers that include wireless communication functionality, as represented by wireless LAN, Bluetooth®, and so on, have been spreading. Wireless communication over wireless LAN, Bluetooth®, and so on is carried out using radio waves in, for example, the 2.5 GHz band, the 5 GHz band, or the like.

A personal computer provided with such wireless communication functionality includes an antenna for wireless communication; various types of antennae are used depending on the model of the computer, such as a dipole antenna, a helical antenna, a slot antenna, an inverted-F antenna, and so on.

Due to reductions in the sizes of electronic devices, these various types of antennae are being required to be mounted in areas that have limited mounting space, and there is also a demand to reduce the costs thereof. To put this differently, attempts are being made to reduce costs by mounting antennae as patterned forms upon the boards of wireless module chips, rather than mounting the antennae separately.

However, in the case where an antenna is mounted in an electronic device such as a PC, there is a problem in that the frequency characteristics of the antenna change depending on the components that are located in the periphery of the antenna, resulting in the frequency characteristics obtained when the antenna is mounted differing from the frequency characteristics obtained when the antenna is in a standalone state.

Thus far, changes in the frequency characteristics of an antenna occurring due to the antenna being mounted in an electronic device are absorbed by the antenna. For example, desired frequency characteristics are achieved for an antenna when the antenna is mounted by using various methods, such as adjusting the shape of the antenna. The following can be given as examples of documents that disclose absorbing, through the antenna, changes in antenna characteristics caused by the surrounding environment of the antenna.

(1) The length of the short stub portion in a radiating element that functions as a cavity resonator is adjusted by changing the location of a through-hole, which adjusts the resonating frequency. The adjustment of the resonating frequency is carried out by changing the length of the stub that configures part of the radiating element (for example, U.S. Pat. No. 5,483,249).

(2) Multiple stubs having free ends are formed connected to a microstrip line-type resonator in advance, and are shorted through soldering in a state where opening patterns are formed in the vicinities of the free ends of the stubs; the resonating frequency is then adjusted by changing the capacities of the stubs connected to the resonator. The adjustment of the resonating frequency is carried out by changing the lengths of the stubs that configure part of a radiating element (for example, Japanese Patent Laid-Open No. 09-162642).

However, there is the following problem with the stated past methods of bringing a change in the frequency characteristics of an antenna, occurring when the antenna is mounted, in line with desired characteristics by adjusting the shape of the antenna. That is, because the environment in which the antenna is mounted differs depending on the type of electronic device, the change in frequency characteristics occurring when the antenna is mounted is not always the same, and thus the same antenna cannot be used in different types of electronic devices.

SUMMARY OF THE INVENTION

The present invention provides an apparatus and a method that make it possible to use the same antenna in different types of devices while improving the reflectance properties when the antenna is mounted.

According to an aspect of the invention, there is provided an antenna used in wireless communication, comprising: a dielectric board, on which is provided an antenna element having a power supply point that supplies a high-frequency signal and whose other end in the propagation direction of the high-frequency signal is an open end that is open at high frequencies, and a GND portion whose length in the vertical direction relative to the propagation direction of the high-frequency signal is a length that is less than ¼ of the wavelength of an operating frequency of the antenna element; and an open conductor having a high-frequency connection to the GND portion, wherein the open conductor and the dielectric board are connected so that the open conductor protrudes by a predetermined length from the GND portion in an opposing corner direction from the power supply point.

Further features of the present invention will become apparent from the following description of exemplary embodiments (with reference to the attached drawings).

BRIEF DESCRIPTION OF THE DRAWINGS

FIG. 10 is a diagram illustrating reflectance loss RL relative to an angle θ shown in FIG. 9 as dB values.

FIG. 14 is a diagram illustrating reflectance loss RL relative to a length Ls shown in FIG. 13 as dB values.

FIG. 16 is a diagram illustrating reflectance loss RL relative to a length Ls shown in FIG. 15 as dB values.

DESCRIPTION OF THE EMBODIMENTS

Embodiments for carrying out the present invention will be described in detail hereinafter with reference to the drawings.

Figure 1:
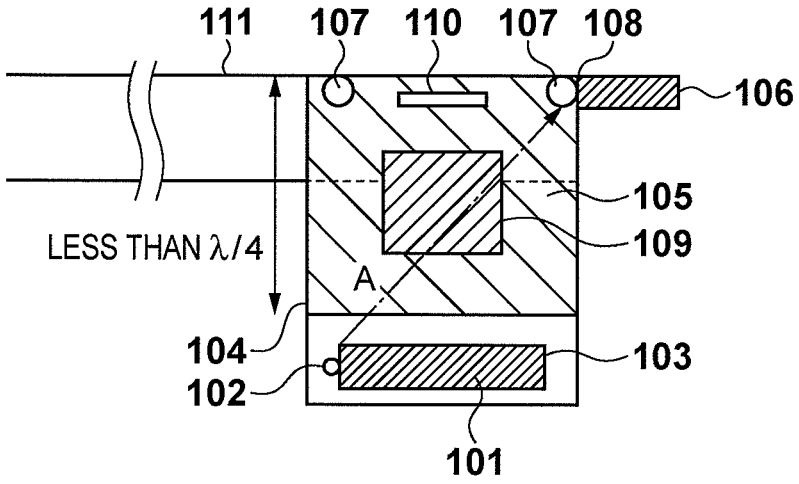
FIG. 1 is a diagram illustrating the overall configuration of an antenna used in wireless communication that is mounted in an electronic device.

FIG. 1 is a diagram illustrating the overall configuration of an antenna used in wireless communication that is mounted in an electronic device. As shown in FIG. 1, the antenna is grounded by a screw or the like using an attachment hole 107 when a dielectric board 104 is attached to a metal housing sheet 111 of the main body of an electronic device (not shown). Note that the method for attaching the antenna is not limited thereto, and may instead employ capacitive coupling that results in a sufficiently low impedance in the operating frequency of the antenna.

Furthermore, an antenna element 101 is mounted on the dielectric board 104, and a wireless module chip 109 is mounted on a GND portion 105. The antenna element 101 is a general monopole antenna, and one end of the antenna element 101 serves as a power supply point 102 for supplying a high-frequency signal, while the other end serves as an open end 103 that is open to the power supply point 102 at high frequencies.

Meanwhile, an open conductor 106 according to the present invention is attached to an end portion 108 of the dielectric board 104 in the opposing corner direction, indicated by a broken line arrow A, when viewed from the power supply point 102 of the antenna element 101, and has a high-frequency connection with the GND portion.

In addition, the dielectric board 104 is provided with a connector 110 for supplying signals to the main body of an electronic device (not shown), the wireless module chip 109, and so on, and furthermore, electrical components such as integrated chips (not shown) are mounted thereon as well.

Next, mounting patterns of the antenna element 101 that is mounted on the dielectric board 104 will be described using FIGS. 2A through 2D and 3A through 3C. The antenna element 101 is a monopole antenna, and is mounted as a conductor pattern or a small-scale chip having an electrical length that is ¼ the wavelength of the operating frequency.

Figure 2A:
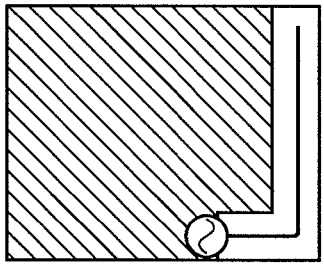
FIGS. 2A through 2D are diagrams illustrating antenna element mounting patterns.
Figure 2B:
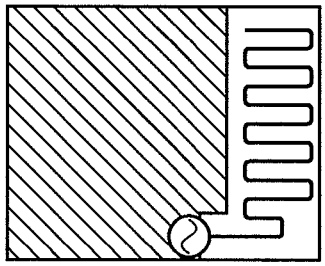
Figure 2C:
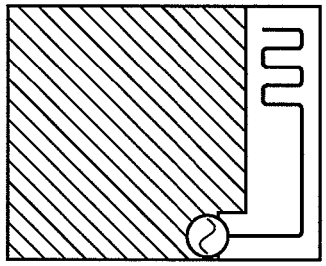
Figure 2D:
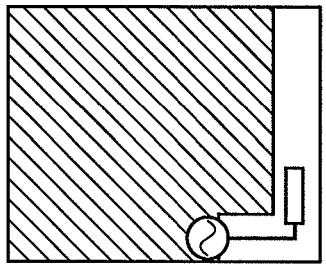
Figure 3A:
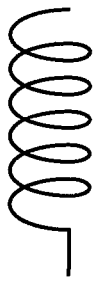
FIGS. 3A through 3C are diagrams illustrating internal patterns of chip antennae.
Figure 3B:
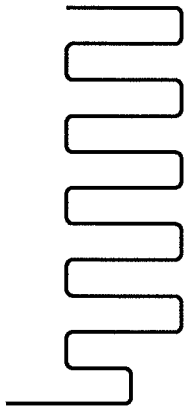
Figure 3C:
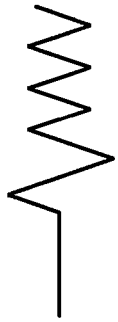

FIG. 2A illustrates an antenna having a straight-line L-shaped pattern, FIG. 2B illustrates an antenna having a pattern with a meandering structure, and FIG. 2C illustrates an antenna having a pattern that is a combination of those shown in FIGS. 2A and 2B. Meanwhile, FIG. 2D illustrates a reduced-sized chip antenna configured of a ceramic, a resin, or the like. FIGS. 3A through 3C are diagrams illustrating the internal structures of chip antennae. FIG. 3A illustrates a pattern for a helical structure, FIG. 3B illustrates a pattern for a meandering structure, and FIG. 3C illustrates a pattern for a zigzag structure.

Returning to FIG. 1, as the electrical length of the GND portion 105 in the dielectric board 104 (that is, the length of the vertical direction relative to the direction in which the high-frequency signal propagates), an electrical length greater than or equal to λ/4 is typically required to cause the antenna element 101 to resonate with a sufficient reflectance coefficient at its operating frequency. Here, λ indicates the wavelength of the center frequency in the operating frequency band.

In other words, normally, if an electrical length greater than or equal to λ/4 cannot be secured for the GND portion 105 of the dielectric board 104 on which the antenna element 101 is mounted, sufficient input reflectance properties cannot be obtained for the antenna element 101.

Figure 4:
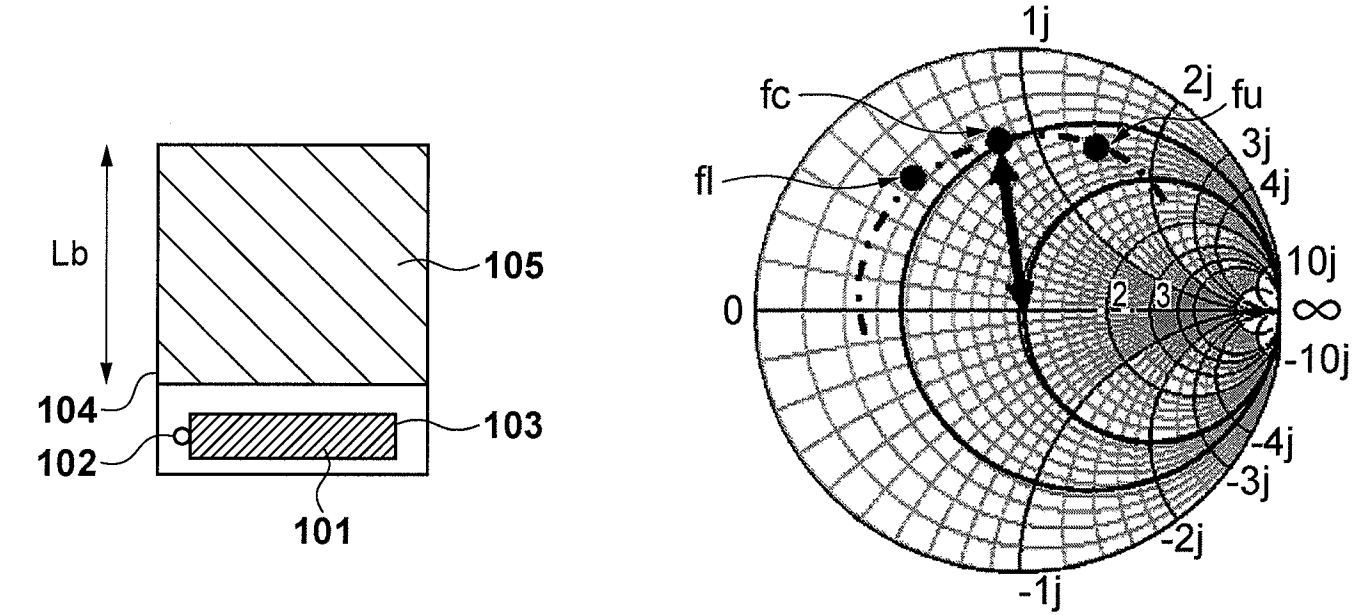
FIG. 4 is a diagram illustrating input reflectance properties of an antenna element in the case where an electrical length greater than or equal to $\lambda/4$ cannot be secured.

FIG. 4 is a diagram illustrating input reflectance properties of the antenna element 101 in the case where an electrical length greater than or equal to λ/4 cannot be secured. Note that elements that are the same as those shown in FIG. 1 are given the same reference numerals, and that the length of the GND portion 105 in the dielectric board 104 is indicated as Lb.

Here, assuming a wireless LAN whose operating frequency band is 2 GHz, λ/4 is approximately 30 mm when the center frequency of the operating frequency band is taken as 2.45 GHz; thus if Lb is a length greater than or equal thereto, sufficient reflectance properties can be obtained for the antenna element 101.

However, in the case where 30 mm cannot be secured for Lb, such as a case in which a length of only approximately 18 mm can be secured, reflectance properties as indicated by the arrow in the Smith chart in the right side of FIG. 4, in which the distance from the center is great, are obtained for the antenna element 101.

VSWR (voltage standing wave ratio) and RL (reflectance loss) exist as indicators of reflectance properties, and closer distances from the center in the Smith chart indicate better reflectance properties. Normally, it is desirable to mount an antenna so that its reflectance properties are VSWR<2.0 and RL<−9.5 dB. A relationship between the voltage standing wave ratio VSWR and the reflectance loss RL is illustrated hereinafter.

$$VSWR=(10RL/20+1)/(10RL/20-1) \quad (1)$$

$$RL=20\ \mathrm{Log}\ 10((VSWR+1)/(VSWR-1)) \quad (2)$$

fl, fc, and fu shown in FIG. 4 indicate bottom, center, and top frequencies, respectively, in the operating frequency band. Generally, if RL is a value greater than or equal to −5 dB, it is not possible to secure a voltage standing wave ratio VSWR that is less than 2.0 (a reflectance loss RL less than −9.5 dB), which is normally required for the reflectance properties of an antenna.

In order to improve this situation, it is necessary to change the pattern of the antenna element 101, change the matching element, or the like, which means that the antenna element 101, the matching element, or the like cannot be reused or shared.

Accordingly, the open conductor 106 according to this embodiment improves the input reflectance properties of the antenna element 101 in the case where a length Lb of greater than or equal to λ/4 cannot be secured for the GND portion 105 in the dielectric board 104 on which the antenna element 101 is mounted.

Hereinafter, the input reflectance properties of the antenna element 101 in the case where the length Lb of the GND portion 105 in the dielectric board 104 is set in advance and a length Ls of the open conductor 106 attached to the dielectric board 104 is changed will be described using FIGS. 5 through 7.

Figure 5:
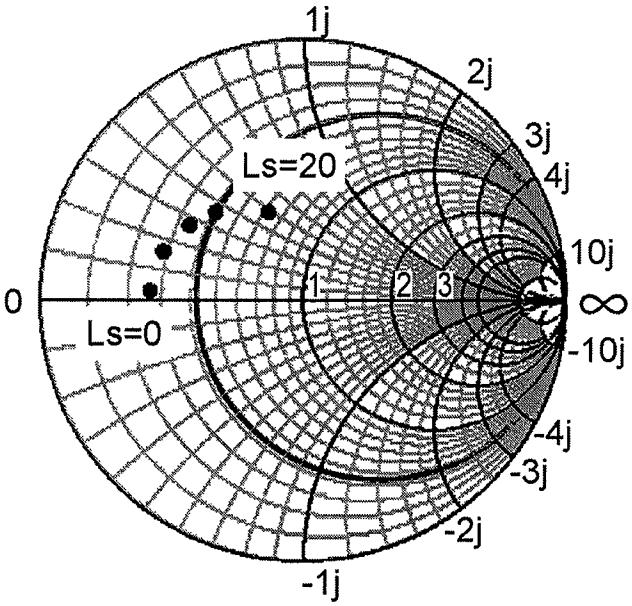
FIG. 5 is a diagram illustrating reflectance properties when a band is 2 GHz, Lb=18 mm, and Ls is changed.
Figure 5:
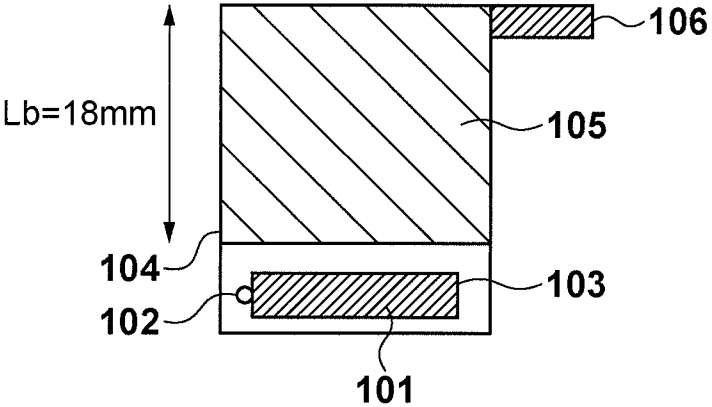

First, the example illustrated in FIG. 5 shows the input reflectance properties of the antenna element 101 when the length Lb of the GND portion 105 is set at 18 mm and the length Ls of the open conductor 106 is changed. The example in FIG. 5 shows a Smith chart for the case where the center frequency of the 2 GHz band of a WLAN is taken as 2.44 GHz and the length Ls of the open conductor 106 is increased at 5 mm intervals from 0 mm to 20 mm.

In the case where the length Lb of the GND portion 105 in the dielectric board 104 is 18 mm, and the length of the open conductor 106 is 0 mm, or in other words, the case where the open conductor 106 is not provided, there is a large reflectance from the input of the antenna element 101, and it is difficult to secure a VSWR that is less than 2.0. However, it can be seen that adjusting the length Ls of the open conductor 106 improves the reflectance properties. According to FIG. 5, generally, a reflectance coefficient where the VSWR is less than 2.0 is obtained by increasing the length of the open conductor 106 to greater than or equal to 20 mm.

Figure 6:
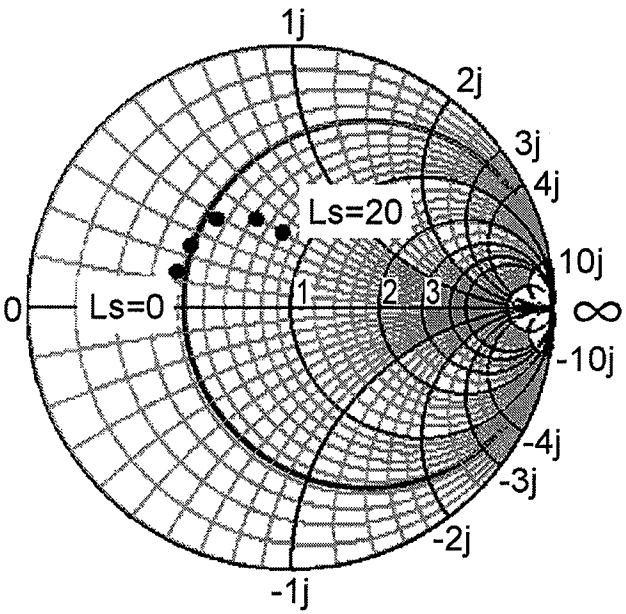
FIG. 6 is a diagram illustrating reflectance properties when a band is 2 GHz, Lb=23 mm, and Ls is changed.
Figure 6:
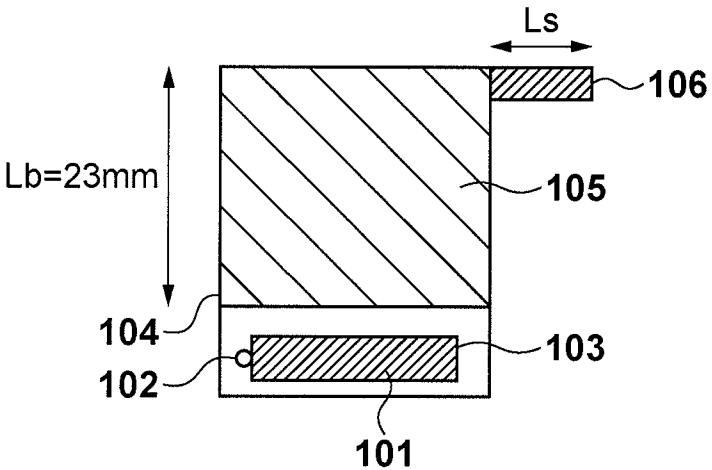

Next, the example illustrated in FIG. 6 shows the input reflectance properties of the antenna element 101 when the length Lb of the GND portion 105 is set at 23 mm and the length Ls of the open conductor 106 is changed. The conditions for measurement in the example shown in FIG. 6 are the same as those for the example shown in FIG. 5, but generally, since the length Lb of the GND portion 105 is 5 mm longer, a reflectance coefficient where the VSWR is less than 2.0 is obtained by increasing the length of the open conductor 106 to greater than or equal to 15 mm.

Figure 7:
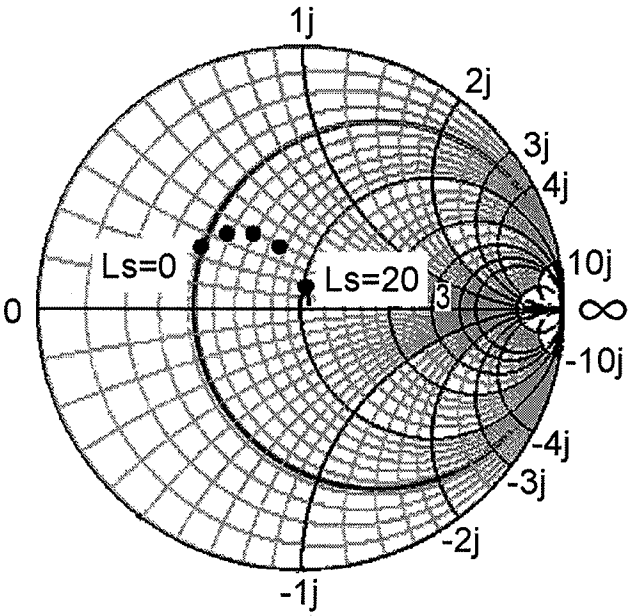
FIG. 7 is a diagram illustrating reflectance properties when a band is 2 GHz, Lb=28 mm, and Ls is changed.
Figure 7:
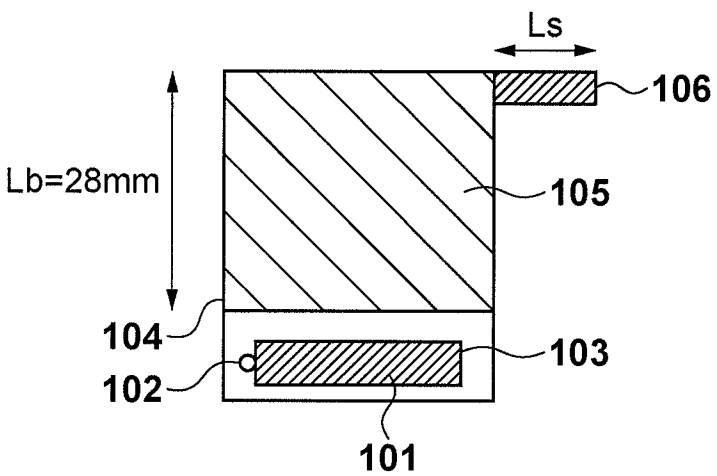

Next, the example illustrated in FIG. 7 shows the input reflectance properties of the antenna element 101 when the length Lb of the GND portion 105 is set at 28 mm and the length Ls of the open conductor 106 is changed. The conditions for measurement in the example shown in FIG. 7 are the same as those for the example shown in FIG. 6, but generally, since the length Lb of the GND portion 105 is 5 mm longer, a reflectance coefficient where VSWR is less than 2.0 is obtained by increasing the length of the open conductor 106 to greater than or equal to 10 mm.

As described above, even in the case where the length of the GND portion in the dielectric board is less than ¼ of the wavelength of the operating frequency, changing the length of the open conductor makes it possible to improve the input reflectance properties of the antenna element without changing the pattern of the antenna element, changing the matching element, and so on.

In other words, when the wavelength of the usage frequency is taken as λ, even in the case where a length of greater than or equal to λ/4 cannot be secured for the length Lb of the GND portion 105, the input reflectance properties of the antenna element 101 can be improved by changing the length Ls of the open conductor 106 in accordance with the length Lb of the GND portion 105.

Figure 8:
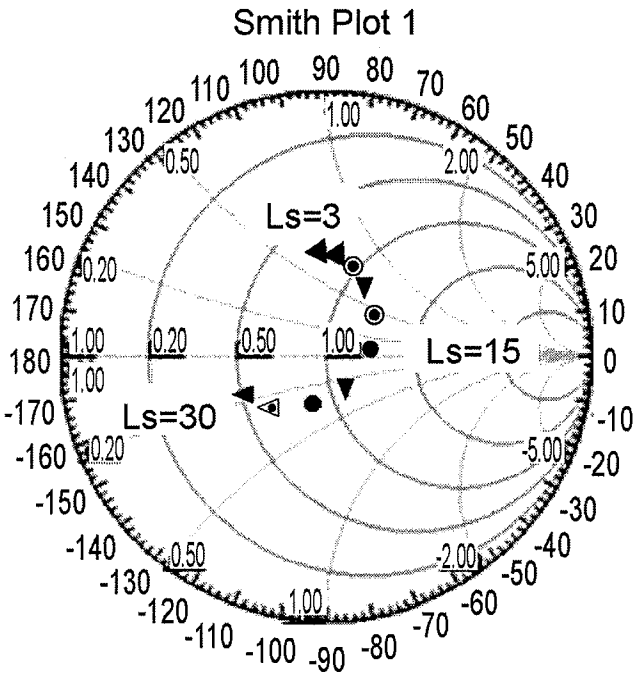
FIG. 8 is a diagram illustrating the results of a simulation of reflectance properties when Ls is changed.
Figure 8:
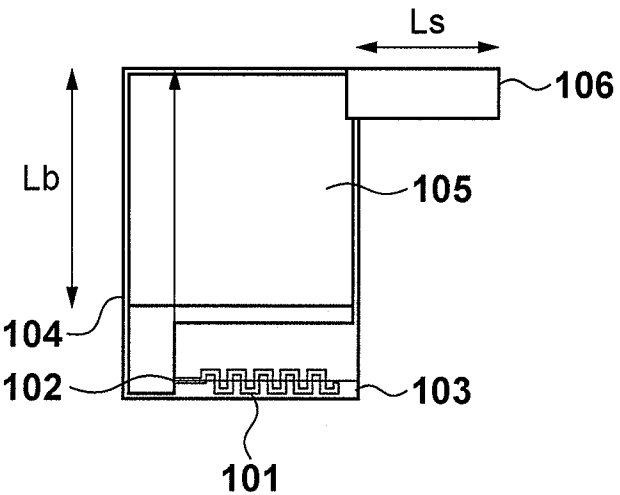

Meanwhile, the example illustrated in FIG. 8 shows the results of simulating a change in the input reflectance properties of the antenna element 101 when the length Lb of the GND portion 105 is set at 30 mm and the length Ls of the open conductor 106 is changed. The measurement conditions assume a center frequency of 2.44 GHz for a 2 GHz band in a WLAN, and the values of the input reflectance coefficient have been plotted. In the example shown in FIG. 8, the length Ls of the open conductor 106 is changed at 3 mm intervals from 3 mm to 30 mm.

According to FIG. 8, in the case where the length Ls of the open conductor 106 is 3 mm, there is a large reflectance from the input of the antenna element 101 and it is difficult to secure a VSWR that is less than 2.0; however, it can be seen that the reflectance properties are improved by increasing the length Ls of the open conductor 106. In other words, a reflectance coefficient where the VSWR is less than 2.0 is obtained by setting the length Ls of the open conductor 106 generally within the range of 9 mm to 24 mm.

Although the above example describes a case in which the open conductor 106 is attached at a fixed angle to the end portion of the dielectric board 104 in the opposing corner direction when viewed from the power supply point 102 of the antenna element 101, it is also possible to obtain a reflectance coefficient where the VSWR is less than 2.0 by changing the angle of attachment. Hereinafter, changes in the input reflectance properties of the antenna element 101 in the case where the angle of attachment of the open conductor 106 has been changed will be described using FIGS. 9 through 11.

Figure 9:
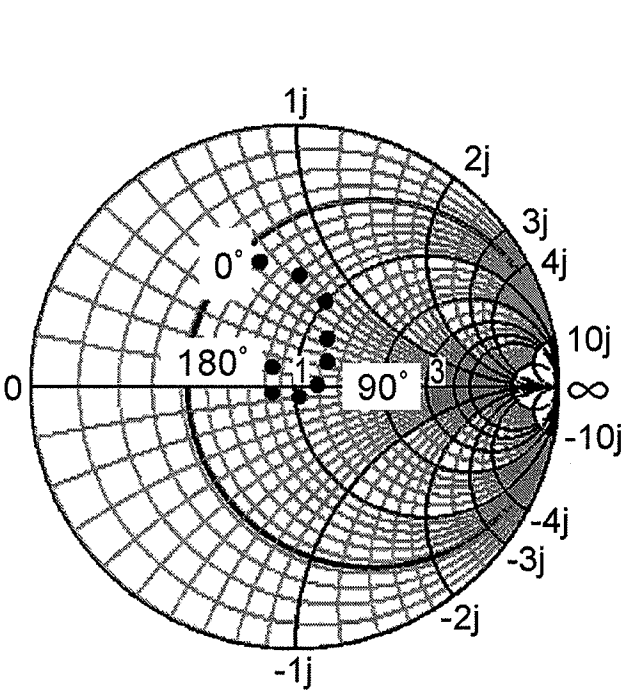
FIG. 9 is a diagram illustrating reflectance properties (a 2 GHz band) in the case where the angle of attachment of an open conductor has been changed.
Figure 9:
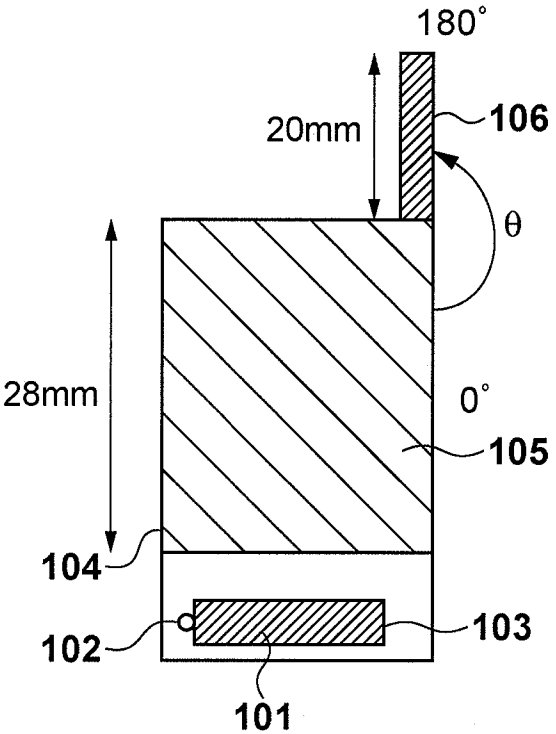

First, in the example shown in FIG. 9, the length Lb of the GND portion 105 in the dielectric board 104 is set to 28 mm, and the length Ls of the open conductor 106 is fixed at 20 mm. The Smith chart illustrates the input reflectance of the antenna element 101 when the angle of attachment of the open conductor 106 is changed from 0° to 180° relative to the side surface of the dielectric board 104.

Meanwhile, the measurement conditions assume a center frequency of 2.44 GHz for a 2 GHz band in a WLAN, and the values of the reflectance coefficient at the points are shown. Furthermore, FIG. 10 is a diagram expressing the reflectance loss RL of the antenna element 101 at each angle in dB values.

According to FIGS. 9 and 10, in the case where the angle is 0°, the open conductor 106 overlaps with the GND portion 105, which is the same as not attaching the open conductor 106; here, there is a large reflectance from the input of the antenna element 101, RL=−7.4 dB, and thus a VSWR that is less than 2.0 cannot be secured. However, it can be seen that the reflectance properties are improved by increasing the angle. Specifically, it can be seen from the values indicated in FIG. 10 that if the angle θ is greater than or equal to 30°, a VSWR that is less than 2.0 can be secured.

Figure 11:
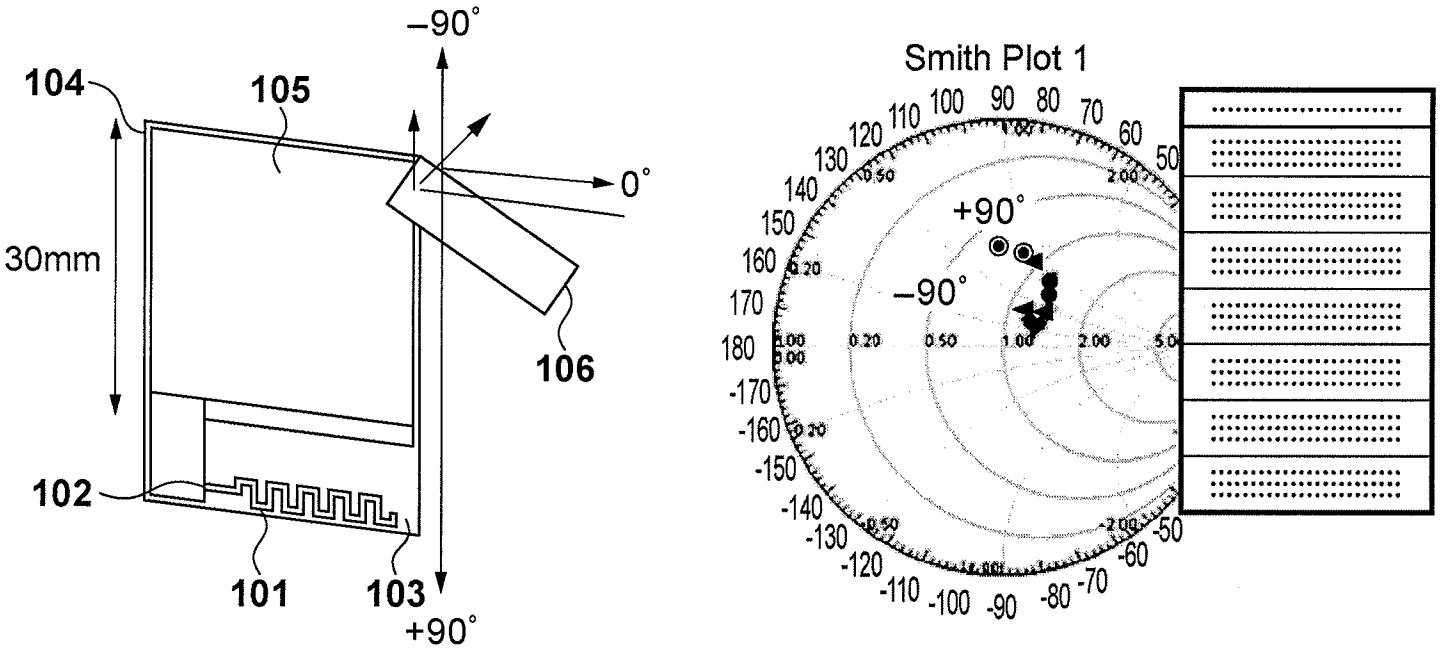
FIG. 11 is a diagram illustrating the results of a simulation of reflectance properties when an angle is changed.

In addition, the example shown in FIG. 11 illustrates the results of simulating the input reflectance properties of the antenna element 101 when the angle of attachment of the open conductor 106 is changed using the end portion of the dielectric board 104 as a base. The conditions of the simulation are as follows: the length Lb of the GND portion 105 in the dielectric board 104 is 30 mm, and the length Ls of the open conductor 106 is 20 mm.

According to FIG. 11, in the case where the angle is +90°, the open conductor 106 overlaps with the GND portion 105, which is the same as not attaching the open conductor 106; here, there is a large reflectance from the input of the antenna element 101, and thus a VSWR that is less than 2.0 cannot be secured. However, it can be seen that the reflectance properties are improved by changing the angle between the open conductor 106 and the dielectric board 104 to +60°, +30°, 0°, −60°, and −90°. Based on the simulation results, it can be seen that a VSWR that is less than 2.0 can be secured if the angle θ is within a range of −90° to +30°.

Figure 12:
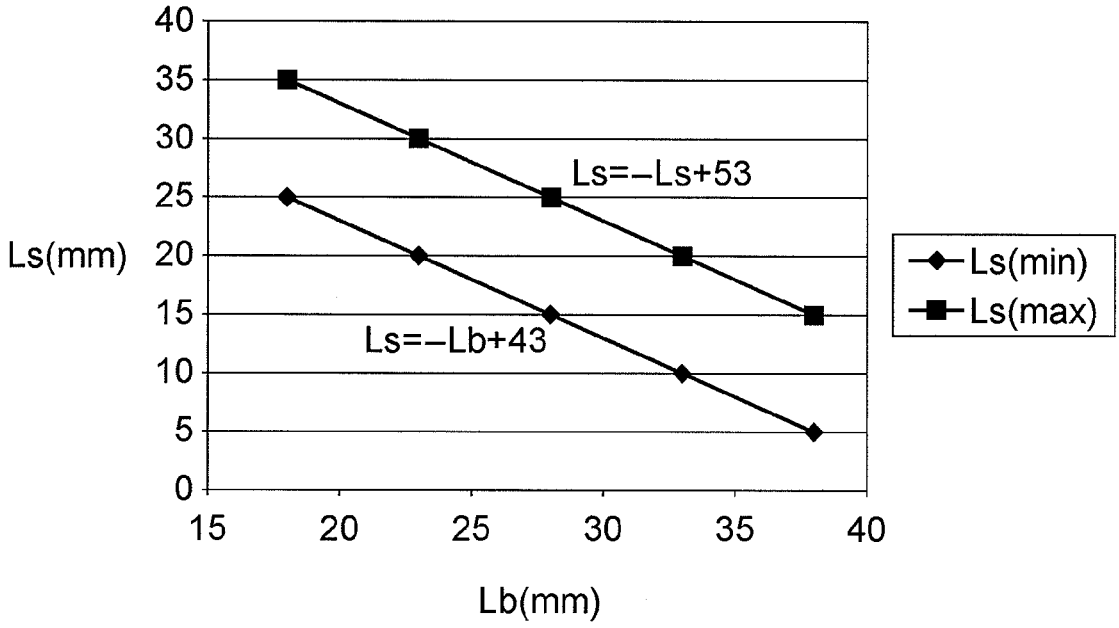
FIG. 12 is a graph illustrating a relationship between a length Lb and a length Ls in a 2 GHz band.

Next, FIG. 12 is a graph illustrating relationship between the length Lb of the GND portion in the dielectric board and the length Ls of the open conductor, for fulfilling an input reflectance coefficient in a 2 GHz band. In FIG. 12, the horizontal axis represents the length Lb of the GND portion, whereas the vertical axis represents the length Ls of the open conductor. Furthermore, Ls(min) indicates the minimum length for the length Lb for obtaining a VSWR that is less than 2.0, whereas Ls(max) indicates the maximum length for the length Lb for obtaining a VSWR that is less than 2.0.

According to FIG. 12, the relationship between the aforementioned length Lb and length Ls is generally indicated by the following straight line relative to the minimum length Ls(min) for obtaining a VSWR that is less than 2.0.

$$Ls=-Lb+53(18<Lb<38)$$

Furthermore, for the maximum length Ls(max) for obtaining a VSWR that is less than 2.0, the relationship is indicated by the following straight line.

$$Ls=-Lb+43(18<Lb<38)$$

In other words, in the case where the relationship between Lb and Ls for obtaining a reflectance coefficient where VSWR is less than 2.0 for the antenna element 101 is Ls=−Lb+K, where K is a constant, and here, 43<K<53 (18<Lb<38).

Next, the input reflectance properties of the antenna element 101 in the case where the open conductor 106 has been attached for a 5 GHz band will be described. As with the aforementioned 2 GHz band, the input reflectance properties of the antenna element 101 in the case where the length Lb of the GND portion 105 in the dielectric board 104 is set in advance and the length Ls of the open conductor 106 attached to the dielectric board 104 is changed will be described using FIGS. 13 through 18.

Figure 13:
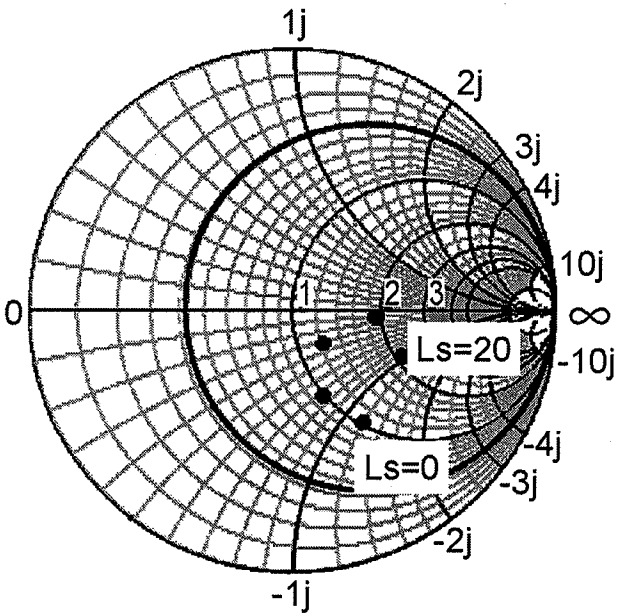
FIG. 13 is a diagram illustrating reflectance properties when a band is 5 GHz, Lb=8 mm, and Ls is changed.
Figure 13:
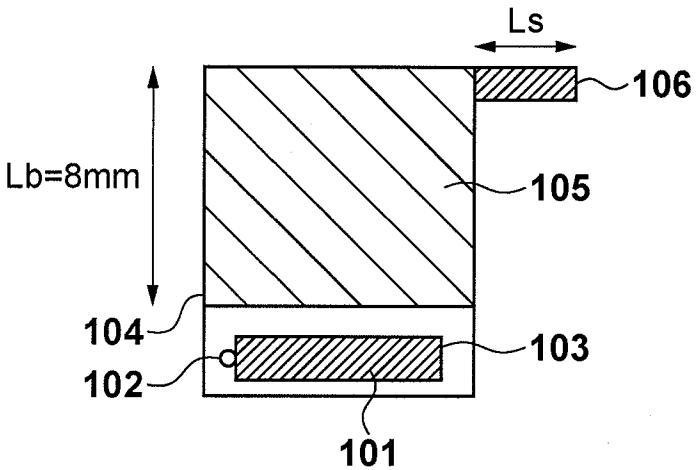

First, the example illustrated in FIG. 13 shows the input reflectance properties of the antenna element 101 when the length Lb of the GND portion 105 is set at 8 mm and the length Ls of the open conductor 106 is changed. The example in FIG. 13 shows a Smith chart for the case where the low frequency of the 5 GHz band in a WLAN is taken as 5.0 GHz and the length Ls of the open conductor 106 is increased at 5 mm intervals from 0 mm to 20 mm.

In the case where the length Lb of the GND portion 105 in the dielectric board 104 is 8 mm, and the length of the open conductor 106 is 0 mm, or in other words, the case where the open conductor 106 is not provided, there is a large reflectance from the input of the antenna element 101, and it is thus difficult to secure a VSWR that is less than 2.0. However, it can be seen that adjusting the length Ls of the open conductor 106 improves the reflectance properties.

Meanwhile, FIG. 14 is a diagram illustrating, in dB, the reflectance loss RL of the antenna element 101 when the length Ls of the open conductor 106 is changed. According to FIG. 14, setting the length Ls of the open conductor 106 to the vicinity of 10 mm results in a reflectance loss RL of −16.0 dB, and thus a reflectance coefficient where VSWR is less than 2.0 is obtained. On the other hand, setting the open conductor 106 to a length that is greater than or equal to 15 mm results in a reflectance loss RL of −6.9 dB, which conversely leads to a deterioration in reflectance properties.

Figure 15:
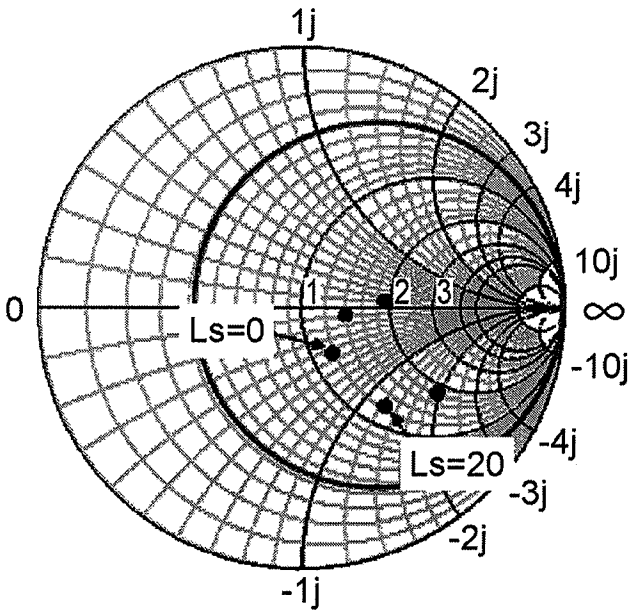
FIG. 15 is a diagram illustrating reflectance properties when a band is 5 GHz, Lb=16 mm, and Ls is changed.
Figure 15:
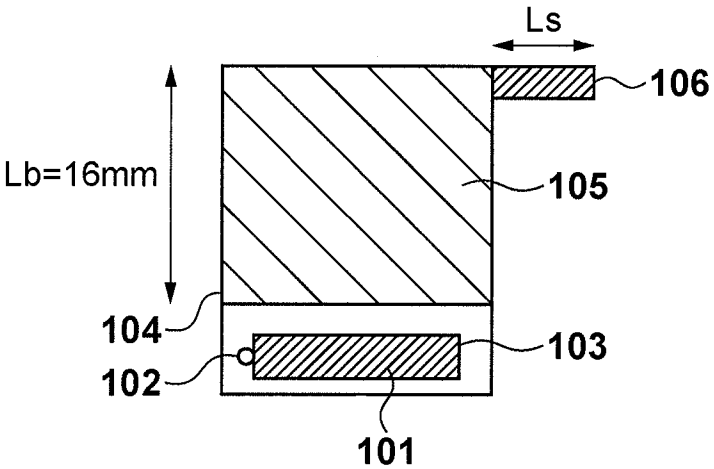

Next, the example illustrated in FIG. 15 shows the input reflectance properties of the antenna element 101 when the length of the GND portion 105 is set at 16 mm and the length Ls of the open conductor 106 is changed, under the same measurement conditions as the example shown in FIG. 13. With the example shown in FIG. 15, since the length Lb of the GND portion 105 is 8 mm longer, a length of greater than or equal to λ/4 can be secured for the GND portion 105 in the dielectric board 104, even if the length Ls of the open conductor 106 is 0 mm, or in other words, even if the open conductor 106 is not provided. Accordingly, a reflectance coefficient where the VSWR is less than 2.0 is obtained.

Meanwhile, FIG. 16 is a diagram illustrating, in dB, the reflectance loss RL of the antenna element 101 when the length Ls of the open conductor 106 is changed. According to FIG. 16, setting the length Ls of the open conductor 106 to the vicinity of 5 mm results in a reflectance loss RL of −12.3 dB, and thus a reflectance coefficient where the VSWR is less than 2.0 is obtained. On the other hand, setting the open conductor 106 to a length that is greater than or equal to 10 mm leads to a deterioration in reflectance properties.

In addition, as with the aforementioned example of 2 GHz shown in FIG. 9, it is also possible, in the 5 GHz band, to obtain a reflectance coefficient where the VSWR is less than 2.0 by changing the angle of attachment of the open conductor 106. Hereinafter, changes in the input reflectance properties of the antenna element 101 in the case where the angle of attachment of the open conductor 106 has been changed will be described using FIG. 17.

Figure 17:
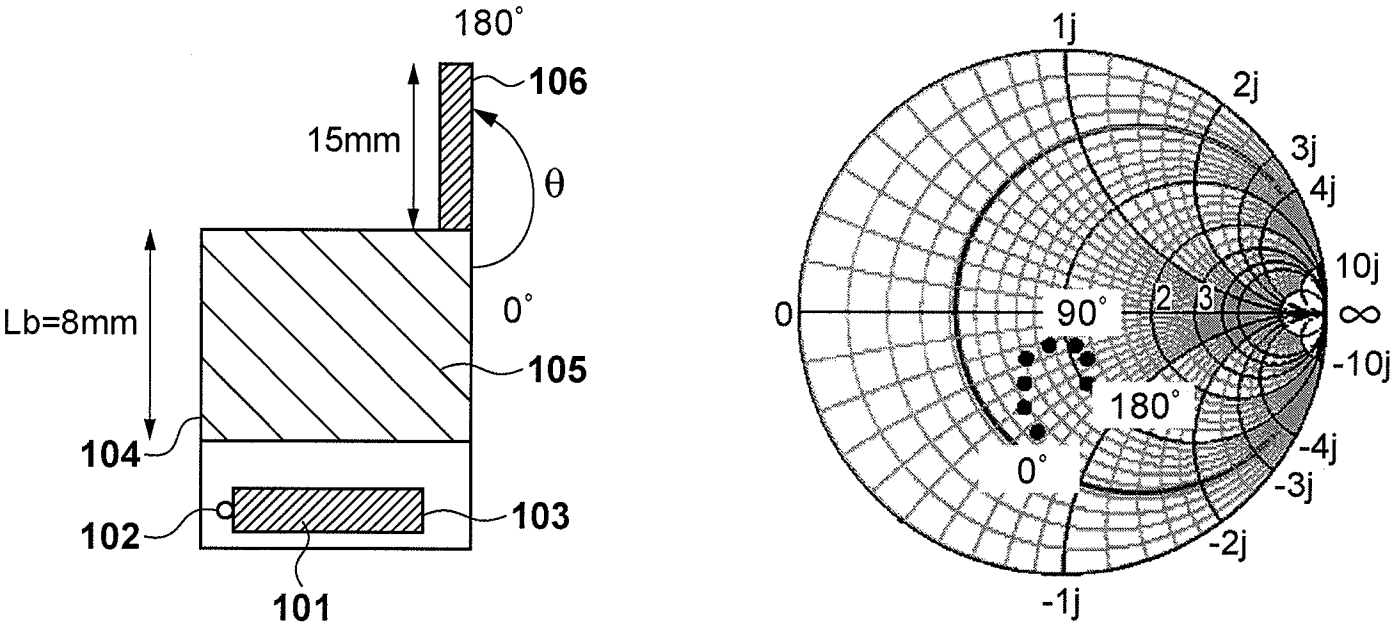
FIG. 17 is a diagram illustrating reflectance properties (a 5 GHz band) in the case where the angle of attachment of an open conductor has been changed.

In the example shown in FIG. 17, the length Lb of the GND portion 105 in the dielectric board 104 is set to 8 mm, and the length Ls of the open conductor 106 is fixed at 15 mm. The Smith chart illustrates the input reflectance of the antenna element 101 when the angle of attachment of the open conductor 106 is changed from 0° to 180° relative to the side surface of the dielectric board 104.

Meanwhile, the measurement conditions assume a frequency of 5.0 GHz for a 5 GHz band in a WLAN, and the values of the reflectance coefficient at the points are shown. Furthermore, FIG. 18 is a diagram expressing the reflectance loss RL of the antenna element 101 at each angle in dB values.

Figures 18, 19:
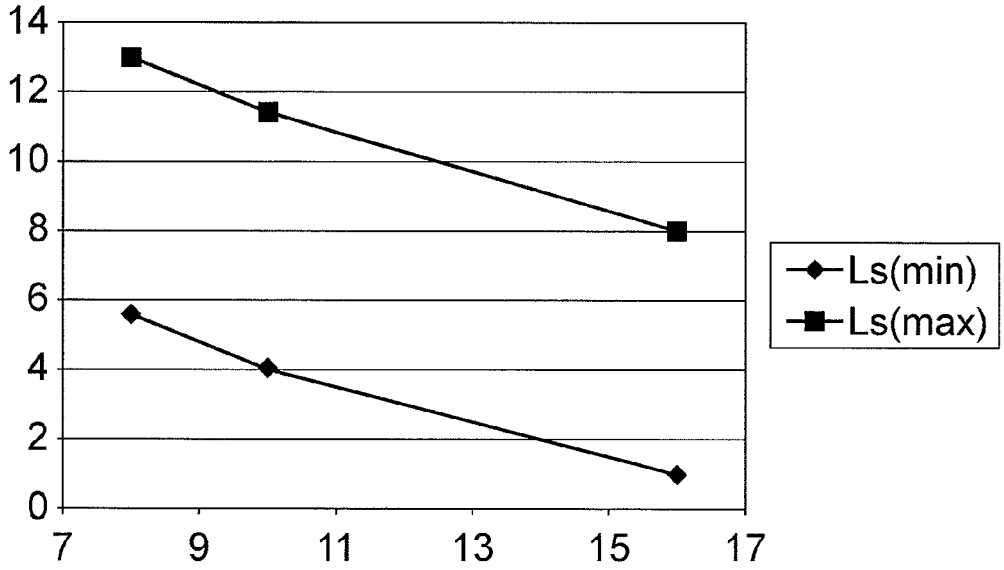
FIG. 18 is a diagram illustrating reflectance loss RL relative to an angle θ shown in FIG. 17 as dB values.
FIG. 19 is a graph illustrating a relationship between a length Lb and a length Ls in a 5 GHz band.

According to FIGS. 17 and 18, in the case where the angle is 0°, the open conductor 106 overlaps with the GND portion 105, which is the same as not attaching the open conductor 106; here, there is a large reflectance from the input of the antenna element 101, RL=−7.3 dB, and thus a VSWR that is less than 2.0 cannot be secured. However, it can be seen that the reflectance properties are improved by increasing the angle. Specifically, it can be seen from the values indicated in FIG. 18 that if the range of the angle θ is 30°<8<180°, a VSWR that is less than 2.0 can be secured.

Next, FIG. 19 is a graph illustrating a relationship between the length Lb of the GND portion in the dielectric board and the length Ls of the open conductor, for fulfilling an input reflectance coefficient in a 5 GHz band. In FIG. 19, the horizontal axis represents the length Lb of the GND portion, whereas the vertical axis represents the length Ls of the open conductor. Furthermore, Ls(min) indicates the minimum length for the length Lb for obtaining a VSWR that is less than 2.0, whereas Ls(max) indicates the maximum length for the length Lb for obtaining a VSWR that is less than 2.0.

According to FIG. 19, the relationship between the aforementioned length Lb and the length Ls is generally indicated by the following straight line for the minimum length Ls(min) for obtaining a VSWR that is less than 2.0.

$$Ls(\min)=-9/16*Lb+10(8<Lb<16)$$

Furthermore, for the maximum length Ls(max) for obtaining a VSWR that is less than 2.0, the relationship is indicated by the following straight line.

$$Ls(\max)=-9/16*Lb+17(8<Lb<16)$$

In other words, the relationship between Lb and Ls for obtaining a reflectance coefficient where VSWR is less than 2.0 for the antenna element 101 is Ls=−Lb+L, where L is a constant, and here, 10<L<17 (8<Lb<16).

Figure 20:
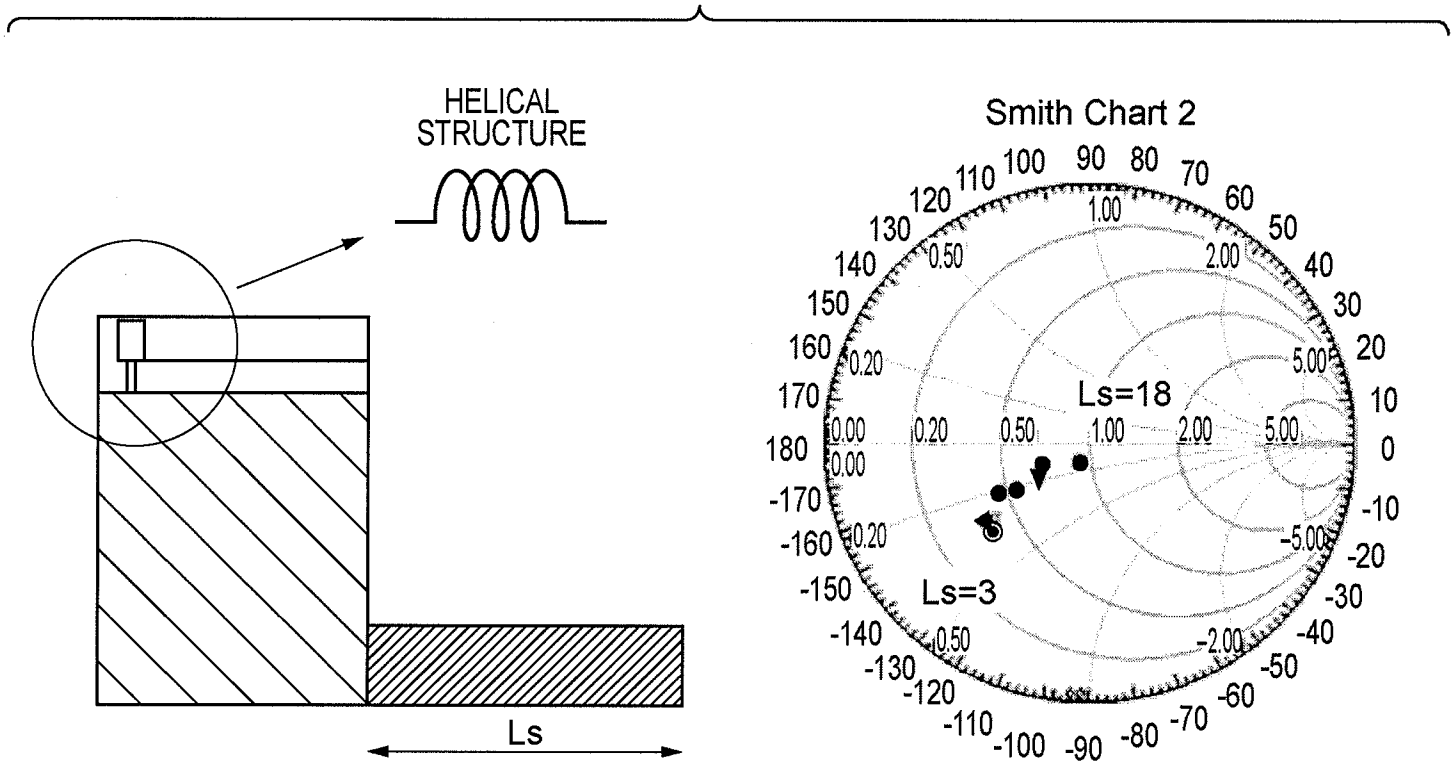
FIG. 20 is a diagram illustrating the results of a simulation when a ceramic chip antenna has been mounted.

Next, the results of a simulation in which a ceramic chip antenna operating in a 2 GHz band is mounted on the dielectric board 104 as the antenna element 101 will be described using FIG. 20. In this example, a monopole antenna having a helical structure is used as the ceramic chip antenna, as shown in FIG. 20.

Meanwhile, the input reflectance properties of the antenna element 101 when the length Lb of the GND portion 105 in the dielectric board 104 is fixed at 18 mm and the length Ls of the open conductor 106 is changed are illustrated in the Smith chart. The measurement conditions in this Smith chart assume a center frequency of 2.44 GHz for a 2 GHz band in a WLAN, and the values of the input reflectance coefficient at the points have been plotted. Here, the points indicate the length Ls being changed at 3 mm intervals from 3 mm to 18 mm.

In the case where the length Lb of the GND portion 105 in the dielectric board 104 is 18 mm, and the length Ls of the open conductor 106 is 3 mm, the input reflectance of the antenna element 101 is great, and it is thus difficult to secure a VSWR that is less than 2.0. However, it can be seen that increasing the length Ls of the open conductor 106 improves the reflectance properties. Specifically, a reflectance coefficient where the VSWR is less than 2.0 is obtained when the length of the open conductor 106 is generally within the range of 9 mm to 18 mm.

As described thus far, the input reflectance properties of the antenna element 101 are improved by setting the open conductor 106 to a desired length in accordance with the length of the GND portion 105 in the dielectric board 104.

Next, working examples of cases in which the same antenna is used across multiple different devices will be described.

Figure 22:
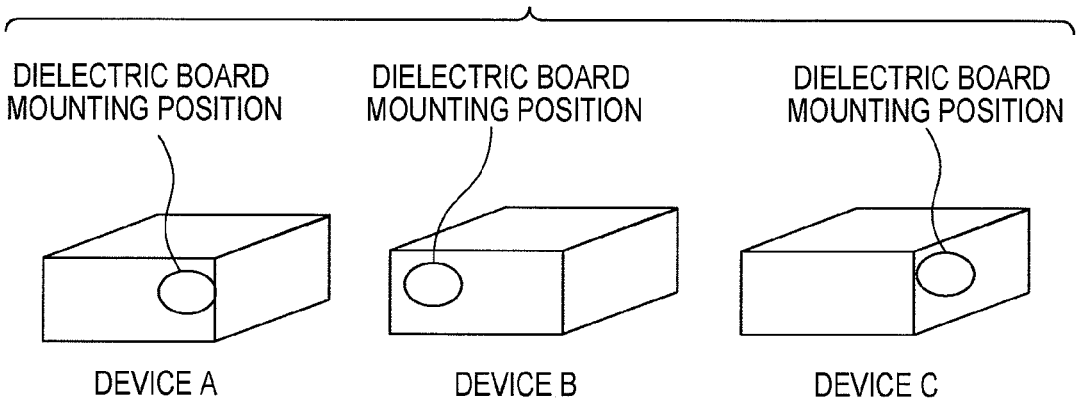
FIG. 22 is a diagram illustrating a wireless unit mounted in multiple different devices.

FIG. 22 illustrates three types of devices, or a device A, a device B, and a device C, in which the same antenna is mounted.

It is assumed here that the same antenna element is mounted in mounting positions that differ among the devices A, B, and C.

Figure 23:
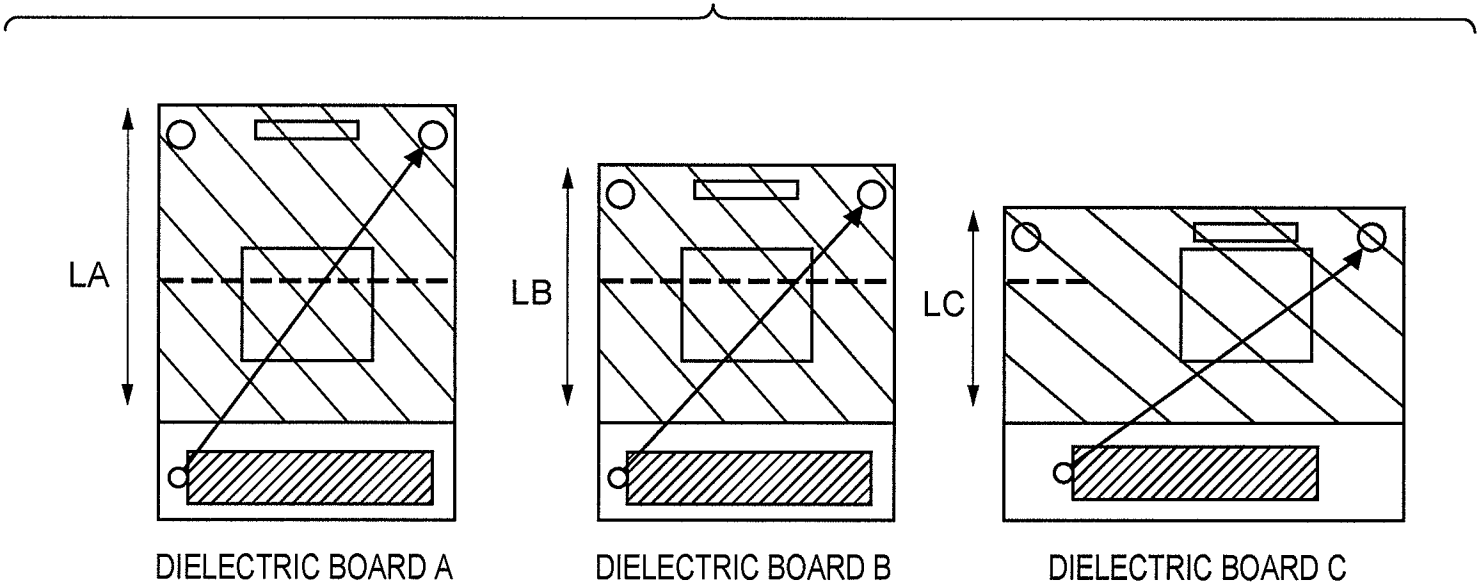
FIG. 23 is a diagram illustrating an example of a case in which the same antenna has been mounted in multiple different devices.

FIG. 23 is a diagram illustrating dielectric boards A, B, and C, on which the same antenna element is provided, that are to be mounted in the different devices A, B, and C.

In FIG. 23, the lengths of the GND portions of the respective dielectric boards differ, and the lengths of the GND portions of the dielectric boards A, B, and C are indicated as LA, LB, and LC, respectively.

The dielectric board A is mounted in the device A, the dielectric board B is mounted in the device B, and the dielectric board C is mounted in the device C; meanwhile, the dielectric board GND lengths LA, LB, and LC are shorter than λ/4 when the wavelength of the center frequency of the usage frequency band is taken as λ.

In the case where the dielectric boards are mounted in devices as described here, favorable reflectance properties are not obtained for the antenna elements that are mounted on the respective dielectric boards.

Because the dielectric board GND length differs for each device in which the antenna is mounted, it is necessary to change the pattern length of the antenna element for each device, change the matching element for each device, or the like.

In such a case, the reflectance properties of the antenna element can be improved by adjusting the length of the open conductor, which is a feature of the present invention, on a device-by-device basis, in accordance with the length of the GND portion of the dielectric board mounted in the device, as has been described thus far.

Figure 24B:
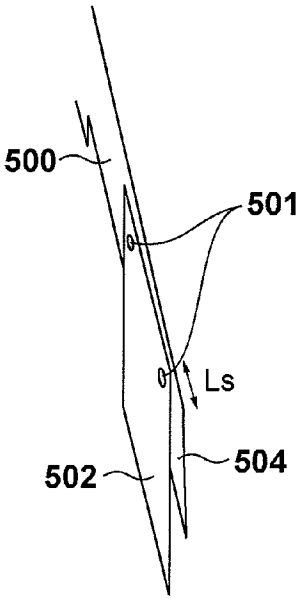
FIGS. 24A and 24B illustrate working examples showing the attachment of an open conductor and a dielectric board to a device, which is a feature of the present invention.
Figure 24A:
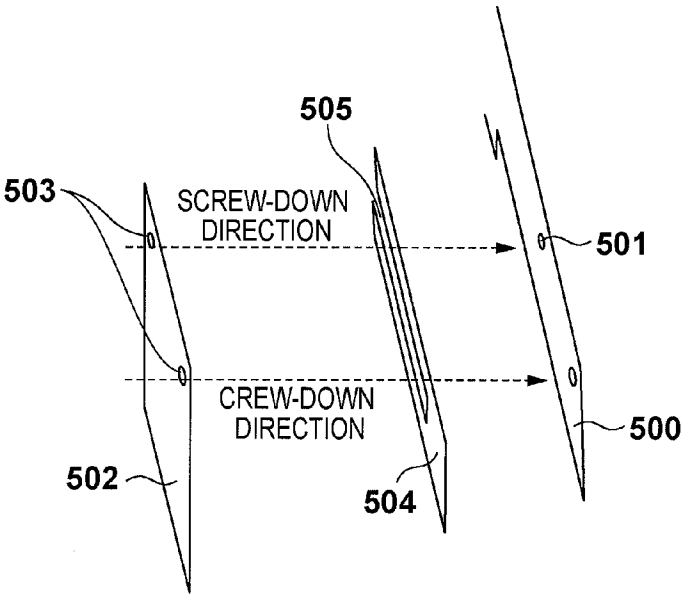

FIGS. 24A and 24B illustrate working examples of the attachment of the open conductor, which is a feature of the present invention, and the dielectric board to a device.

In FIG. 24A, 500 indicates a metal housing sheet within an electronic device (not shown); the metal housing sheet 500 includes a screw hole 501 to which a dielectric board 502 is attached.

504 indicates the open conductor, which is a feature of the present invention; the open conductor 504 includes a slit portion 505 in its central portion, is inserted between the dielectric board 502 and the metal housing sheet 500, and is grounded in a high-frequency state when screwed down through the screw hole 501 and the dielectric board 502, the open conductor 504, and the metal housing sheet 500 are connected.

FIG. 24B illustrates a state in which the open conductor and the dielectric board have been attached to the metal housing sheet. This state of attachment is the same as that illustrated in FIG. 1.

The open conductors 106 and 504 are the same members in FIG. 1 and in FIGS. 24A and 24B.

Likewise, the metal housing sheet indicated by 111 in FIG. 1 is the same member as the metal housing sheet 500 shown in FIGS. 24A and 24B.

Furthermore, the dielectric board 104 shown in FIG. 1 and the dielectric board 502 shown in FIGS. 24A and 24B are the same members.

In this manner, the open conductor 504, which is a feature of the present invention, has a high-frequency connection by being screwed down between the metal housing sheet 500 of the electronic device itself and the dielectric board 502.

Figure 25:
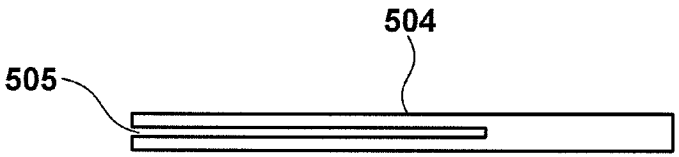
FIG. 25 is a diagram illustrating the configuration of an open conductor.

FIG. 25 is a diagram illustrating the configuration of the open conductor 504.

In FIG. 25, 504 indicates the open conductor, whereas 505 indicates a long-hole or a slit for screwing the open conductor down onto the metal housing sheet 500; the configuration is such that the length Ls by which the open conductor 504 protrudes from the end of the dielectric board 502 can be adjusted by moving the open conductor in the direction of the arrow, as shown in FIG. 24B.

Accordingly, the adjustment of the reflectance properties of the antenna is carried out by sliding the open conductor that protrudes from the end of the dielectric board 502 in the direction of the arrow, thereby changing the length Ls.

As a result, the reflectance properties are adjusted to the optimal reflectance properties by changing the length Ls of the open conductor that protrudes from the GND portion of the dielectric board in accordance with the GND length of the dielectric board 502 that is mounted in that particular type of device.

Variation

Figure 21:
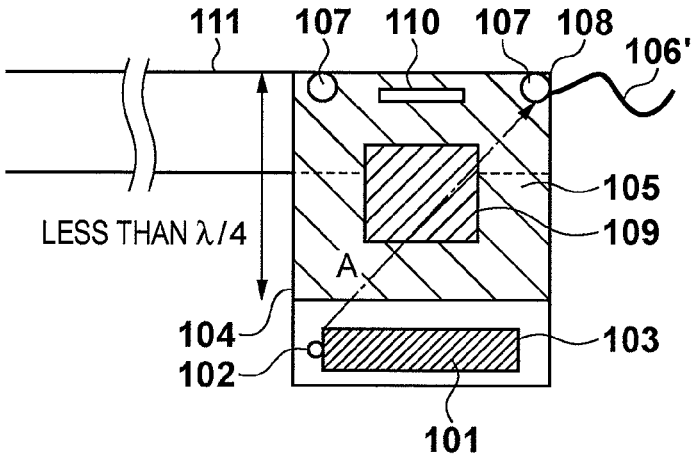
FIG. 21 is a diagram illustrating a variation on an open conductor.

Next, a variation on the aforementioned open conductor 106 will be described using FIG. 21. The open conductor 106 need not be a sheet-shaped metal plate (conductive member), and may instead be a conductor 106' having a desired length, as shown in FIG. 21.

In addition, the configuration may be such that the open conductor is copper foil of a predetermined length that has been coated in a highly-conductive flexible resin.

According to the present invention, the reflectance properties of an antenna element can be improved without changing the shape of the antenna element, the matching element, or the like, and favorable properties can be obtained for different types of devices even when using the same antenna. Accordingly, the manufacture and management of the antenna is extremely easy, and it is also possible to achieve a reduction in costs.

OTHER EMBODIMENTS

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-270793, filed Dec. 3, 2010 and 2011-225300, filed Oct. 12, 2011, which are hereby incorporated by reference herein in their entirety.

What is claimed is:

1. An antenna used in wireless communication, comprising:

a dielectric board, on which is provided an antenna element having a power supply point that supplies a high-frequency signal and whose other end in the propagation direction of the high-frequency signal is an open end that is open at high frequencies, and a GND portion whose length in the vertical direction relative to the propagation direction of the high-frequency signal is a length that is less than ¼ of the wavelength of an operating frequency of the antenna element; and an open conductor having a high-frequency connection to the GND portion, wherein the open conductor and the dielectric board are connected so that the open conductor protrudes by a predetermined length from the GND portion in an opposing corner direction from the power supply point.

2. The antenna according to claim 1, wherein the length by which the open conductor protrudes from the GND portion is adjustable.

3. The antenna according to claim 1, wherein the length by which the open conductor protrudes from the GND portion is dependent on the length of the GND portion in the vertical direction relative to the propagation direction of the high-frequency signal.

4. The antenna according to claim 1, wherein the open conductor is connected to the dielectric board so as to have an angle θ relative to the GND portion that fulfills $30° < \theta < 180°$.

5. The antenna according to claim 1, wherein the location at which the open conductor protrudes from the GND portion is an end area of the GND portion.

6. An electronic device in which the antenna according to claim 1 is mounted.

7. An adjustment method for an antenna used in wireless communication, the antenna including a dielectric board on which is provided an antenna element having a power supply point that supplies a high-frequency signal and whose other end in the propagation direction of the high-frequency signal is an open end that is open at high frequencies, and a GND portion whose length in the vertical direction relative to the propagation direction of the high-frequency signal is a length that is less than ¼ of the wavelength of an operating frequency of the antenna element, and including an open conductor having a high-frequency connection to the GND portion at an end of the dielectric board in an opposing corner direction from the power supply point, the method comprising:

adjusting an input reflectance coefficient of the antenna element by changing the length by which a portion of the open conductor protrudes from the GND portion in the opposing corner direction from the power supply point in accordance with the length of the dielectric board in the vertical direction relative to the propagation direction of the high-frequency signal.

* * * * *